United States Patent [19]

Slegeir et al.

[11] Patent Number: 4,561,859

[45] Date of Patent: Dec. 31, 1985

[54] LOW TEMPERATURE AQUEOUS DESULFURIZATION OF COAL

[75] Inventors: William A. Slegeir, Hampton Bays; Francis E. Healy, Massapequa; Richard S. Sapienza, Shoreham, all of N.Y.

[73] Assignee: The United States of America as represented by the United States Department of Energy, Washington, D.C.

[21] Appl. No.: 724,431

[22] Filed: Apr. 18, 1985

[51] Int. Cl.[4] ..... C10L 9/02

[52] U.S. Cl. ..... 44/1 SR; 201/17; 423/461; 75/6

[58] Field of Search ..... 44/1 SR; 201/17; 75/6; 423/461

[56] References Cited

U.S. PATENT DOCUMENTS

| | | | |
|---|---|---|---|
| 1,303,362 | 5/1919 | Mott | 423/461 |
| 1,643,272 | 9/1927 | Hellthaler | 208/295 |
| 3,166,483 | 1/1965 | Masciantonio | 201/17 X |
| 3,567,377 | 3/1971 | Lefrancois et al. | 208/235 X |
| 3,909,213 | 9/1975 | Sanders | 44/1 SR |
| 4,022,588 | 5/1977 | Dessau | 44/1 SR |
| 4,118,200 | 10/1978 | Kruesi | 44/1 SR |
| 4,127,390 | 11/1978 | Dondelewski | 44/1 SR |
| 4,233,034 | 11/1980 | Miller et al. | 44/1 SR |

FOREIGN PATENT DOCUMENTS

| | | | |
|---|---|---|---|
| 2914306 | 10/1980 | Fed. Rep. of Germany | 201/17 |
| 883544 | 11/1961 | United Kingdom | 423/461 |

OTHER PUBLICATIONS

Petroleum Refining with Chemicals, Kalichevsky et al., Elsevier Publishing, N.Y., 1956, pp. 224–232.

*Primary Examiner*—Carl F. Dees

*Attorney, Agent, or Firm*—Margaret C. Bogosian; Paul A. Gottlieb; Judson R. Hightower

[57] ABSTRACT

This invention describes a chemical process for desulfurizing coal, especially adaptable to the treatment of coal-water slurries, at temperatures as low as ambient, comprising treating the coal with aqueous titanous chloride whereby hydrogen sulfide is liberated and the desulfurized coal is separated with the conversion of titanous chloride to titanium oxides.

9 Claims, No Drawings

LOW TEMPERATURE AQUEOUS DESULFURIZATION OF COAL

The U.S. Government has rights in this invention pursuant to Contract Number DE-AC02-76CH00016, between the U.S. Department of Energy and Associated Universities Inc.

BACKGROUND OF THE INVENTION

This invention relates to the desulfurization of coal or coal water mixtures employing titanium compounds. Applicants have found that the treatment of some coals with an aqueous solution of titanous chloride (titanium trichloride and $TiCl_4$ are equivalent representations of this material) results in the liberation of copious amounts of hydrogen sulfide. This result is surprising in light of the difficulty generally encountered in the removal of coal-bound sulfur.

It has long been known that heating coal to coking temperatures will liberate much of the contained sulfur. U.S. Pat. No. 3,166,483 describes a process whereby coal is partially desulfurized with molten KOH/NaOH at temperatures between 200° and 400° C. Alternatively, U.S. Pat. No. 3,567,377 teaches that less corrosive $Na_2CO_3$ may be employed but temperatures in the range of 850°–1100° C. are required. A significant body of work has been directed toward employing air in oxidative desulfurization but generally high temperatures and pressures are employed, as shown in U.S. Pat. No. 3,824,084. In these prior art processes, fuel losses generally occur and the oxidized sulfur is frequently difficult to remove.

U.S. Pat. No. 1,643,272 describes a process for refining sulfur-containing mineral oils by treatment with titanium tetrachloride. This process requires dilution with an inert substance such as clay, bleaching earth, Fuller's earth, or the like in order to improve the utilization of the titanium tetrachloride reagent and to improve the color of the recovered oil. Obviously the reference process is an anhydrous process where the titanium tetrachloride and the inert substance, Fuller's earth for example, are added to the mineral oil. The presence of water in this process would render the process inoperative since the oil/water phases would not mix. In addition titanium tetrachloride is unstable in the presence of water. In contrast, in the present invention the coal is desulfurized by treatment with an aqueous solution of $TiCl_3$. This solution is active toward coal in water and is effective at room temperature in the absence of any bleaching additive to provide desulfurization by $H_2S$ liberation in the aqueous phase.

The instant invention describes a reductive process, with distinct advantages over the prior processes, that will accomplish desulfurization and will not result in coal loss. Further, hydrogen sulfide is a gas of only moderate water solubility, allowing for reasonable sulfur separation schemes. Titanous chloride is the preferred titanium compound for use in the present invention, although other tervalent water stable titanium salts may be employed. The $TiCl_3$ has two distinct advantages; it is effective at room temperature and can also be used in aqueous solutions. Most other reagents that have been tested for removing coal-bound sulfur are rapidly destroyed by water.

The reaction of the present invention is as follows:

$$\text{Powdered Coal} + TiCl_3 \xrightarrow{H_2O} H_2S + \text{partially desulfurized coal (slurried)} + \text{Titanium Oxides}$$

The reaction is conveniently carried out at ambient pressure and temperatures as low as room temperature are effective. $TiCl_3$ is commercially available in solid pure form or in hydrated form as titanium trichloride hexahydrate, the latter used commercially as a bleaching or stripping agent in the dyeing industry. It is also conveniently available as an aqueous solution.

When a solution of titanous chloride is reacted with iron disulfide (pyrite) in the presence of water, a vigorous evolution of hydrogen sulfide results. However, this reagent is inactive toward dibenzothiophene. From these results it would appear that titanous chloride is most effective with inorganic sulfur.

Those skilled in the art will readily recognize that hydrochloric acid will interact with iron sulfides to liberate hydrogen sulfide. Furthermore, some early transition metal halides partially hydrolyze to generate HCl. However, we have been unable to observe any reaction between dilute hydrochloric acid and coal, nor are we aware of any reports of such reactions occuring under conditions approximating those of the instant invention.

That the chloride anion or metal chlorides in general were ineffective was demonstrated by allowing coal to sit in the presence of aqueous solutions of sodium chloride, manganese chloride, cobalt chloride, stannous chloride and zinc chloride. In all cases no hydrogen sulfide could be detected. In contrast, in those reactions employing titanous chloride, significant bubbling is observed with copious liberations of $H_2S$. Like titanous chloride, both manganese and stannous chloride can be regarded as reducing agents but they are ineffective in liberating $H_2S$. Zinc and stannous chlorides have been used as catalysts in treatment of coal, specifically its hydrogenation, but under much more severe conditions. The reducing properties of titanous chloride are well known, since it has been employed in titrations for nitro and azo groups as well as for the ferric ion. However, the present invention represents its first use in the desulfurization of coal.

SPECIFIC DISCLOSURE

The present invention differs from prior chemical treatments of coal in the following respects:

(a) a lower temperature of reaction is maintained, e.g., as low as room temperature;

(b) the use of aqueous reaction conditions;

(c) the use of aqueous solutions of titanous chloride, e.g., varying from about 1% by weight up to about 10% by weight, preferably 2–6% by weight and optimum range 2–3% by weight;

(d) the use of coal in finely divided form so as to provide reasonable contact between the coal and the aqueous solution;

(e) the intimate contact between the titanous chloride solution and the coal for a period of at least 10 minutes by spray, or for ½ to 2 hours by soak, in order to provide for substantial removal of sulfur from the coal and the formation of titanium oxides. However, a spray or soak with a shortened time removes a substantial portion of the sulfur; and (f) the coal can be used in a coal water slurry form and the slurry treated with the aqueous $TiCl_3$ solution. In the slurry approach, it is also possible to pass an inert gas through the slurry to help liberate the $H_2S$ or to use a conventional sulfur sorbent to help liberate the $H_2S$. If an inert gas is used, it can be re-cycled through the slurry after being passed through an $H_2S$ sorbent.

Certain kinds of high sulfur or medium sulfur coal react immediately, e.g., in a reaction time of about 5–10 minutes, to provide for sulfur removal, while other kinds of coal may take a longer reaction time at room temperature.

EXAMPLE 1

The following example illustrates treatment of upper Thacker (hvb) coal for a period of 4 hours.

Upper Thacker (hvb) coal is ground through ¼ mesh and washed with an equal volume of 2% titanous chloride in water solution with intermittent agitation for a period of 1 hour at room temperature (20°—25° C.). The liberation of hydrogen sulfide is apparent immediately. At the end of 4 hours the coal is separated and found to be significantly lower in inorganic sulfur content.

EXAMPLE 2

To a slurry of 12.0 g Upper Thacker coal (70% <200 mesh, reported to contain 1.7% S, 5.1% ash, of which 15.7% is as $Fe_2O_3$) in 25 ml distilled water was added 10 ml of a 20% aqueous $TiCl_3$ solution. A small amount of warming was observed. To facilitate the liberation of $H_2S$, a gentle stream of argon was passed through the slurry. Slow $H_2S$ liberation continued overnight.

The solution was filtered. The color of the filtrate indicated that unreacted $TiCl_3$ was present.

The recovered moist residue weighed 14.3 g and was divided into two portions, the first weighing 7.69 was dried at 100° C. for 4 hours. A weight loss of 2.1 g was observed due to drying.

The second portion of the recovered coal was washed with concentrated NaOH to remove any titanium residues, and then repeatedly rinsed with water. In this way 6.8 g of coal were recovered, amounting to 5.5 g after dying 4 hours at 100° C.

The starting coal and the two treated portions were analyzed for total sulfur. The results were:

Starting Coal: 1.6%,
Portion 1: 1.4%,
Portion 2: 1.3%, indicating nearly 20% sulfur removal.

We claim:

1. A method of desulfurizing coal which comprises treating coal with an effective aqueous amount of titanous chloride.

2. The method according to claim 1 wherein the aqueous titanous chloride is utilized at weight percent of 1%–10%.

3. The method according to claim 1 wherein the aqueous titanous chloride is utilized at a weight percent of about 2%.

4. The method according to claim 1 wherein a dilute, aqueous $TiCl_3$ solution is sprayed over coal for the purpose of liberating sulfur as $H_2S$.

5. A method of treating a coal water slurry, whereby an appropriate amount of titanous chloride is added either as a solid or as an aqueous solution to the slurry.

6. The method according to claim 5 wherein an inert gas is passed through the treated slurry to help liberate hydrogen sulfide.

7. The method according to claim 5 wherein a sorbent is employed to help liberate $H_2S$.

8. The method according to claim 6 wherein the inert gas is recycled after being passed through a sorbent effective for $H_2S$.

9. A method of preparing a coal water slurry in which finely divided coal is suspended in a dilute solution of titanous chloride.

* * * * *